United States Patent [19]

Surko, Jr.

[11] 4,208,894

[45] Jun. 24, 1980

[54] CAM LOCK

[75] Inventor: Walter E. Surko, Jr., Southington, Conn.

[73] Assignee: Emhart Industries, Inc., Hartford, Conn.

[21] Appl. No.: 939,059

[22] Filed: Sep. 1, 1978

[51] Int. Cl.[2] ..... E05B 27/04

[52] U.S. Cl. ..... 70/364 A

[58] Field of Search ..... 70/364 A, 364 R, 419, 70/376, 378

[56] References Cited

U.S. PATENT DOCUMENTS 4,103,526 8/1978 Surko .

*Primary Examiner*—Robert L. Wolfe

*Attorney, Agent, or Firm*—McCormick, Paulding & Huber

[57] ABSTRACT

A key operated cam lock including a shell and a rotary key plug and having axially elongated pin tumbler assemblies each comprising a plurality of tumbler elements including a pin tumbler carried by the key plug and a driver carried by the shell. A projection on an end of one of the tumbler elements of each tumbler assembly is received in a slot in the end of another associated element and serves to couple a driver to an associated pin tumbler when the key plug is in locked position. V-shaped bits on the key engagable with complementary V-shaped chisel tips on the pin tumblers axially and angularly position the pin tumbler assemblies in unlocked position wherein slots in various tumbler elements are aligned with annular grooves in the key plug eccentric to the axis of plug rotation. The projections escape from the slots and enter the grooves when the key plug is rotated from locked position toward an unlocked position. The tumbler elements having projections thereon may be axially symmetrical.

10 Claims, 9 Drawing Figures

CAM LOCK

BACKGROUND OF THE INVENTION

This invention relates in general to locks and deals more particularly with improved cam locks of the type used on vending machines, coin boxes, panel boxes, office furniture and the like. Such a lock usually has a generally cylindrical shell, a rotary key plug supported within the shell, and a cam mounted on the inner end of the key plug and adapted for locking engagement with an associated strike or keeper. In accordance with accepted standards for such cam locks, the shell usually has a ¾ inch outside diameter and is threaded to receive a retaining nut used in mounting the lock. The requirements of a particular lock installation may impose further limitation on the axial length of the shell. Conventional pin tumbler, disc tumbler or side bar locking mechanism are usually utilized in such a lock and affords moderate security. While various other locking mechanisms are available which offer higher degrees of security, such locking mechanisms are not usually found in cam locks of the aforedescribed type, because of spatial limitations within the plug and shell. Heretofore, at least one cam lock has been provided which offers a higher degree of security than previously attainable with the aforementioned well known conventional locking mechanisms. This lock, illustrated and described in U.S. Pat. No. 3,499,302 to Spain et al, utilizes pin tumblers which are raised, lowered and axially rotated to release a fence or side bar, and may be best characterized as an improved side bar lock.

It is the general aim of the present invention to provide improved cam locks of high security type of simple construction and having locking members which consist solely of pin tumbler assemblies.

SUMMARY OF THE INVENTION

In accordance with the present invention, a key operated cam lock is provided which includes a pin tumbler assembly having a plurality of tumbler elements including a pin tumbler carried by a key plug, and a driver carried by a shell. The tumbler assembly further includes means for coupling the driver to the pin tumbler when the plug is in locked position relative to the shell and which comprises a slot opening axially outwardly through an end of one of the tumbler elements and extending generally diametrically through the one element and a projection on the end of another of the tumbler elements and received within the slot when the key plug is in its locked position. A V-shaped bit on the key engages a V-shaped chisel tip on the pin tumbler to align the slot with an annular groove in the key plug whereby to release the key plug for rotation to an unlocked position relative to the shell. The axis of the annular groove is offset from and parallel to the axis of plug rotation. The other locking element and its projection may be axially symmetrical.

DETAILED DESCRIPTION OF PREFERRED EMBODIMENTS

Figure 1:
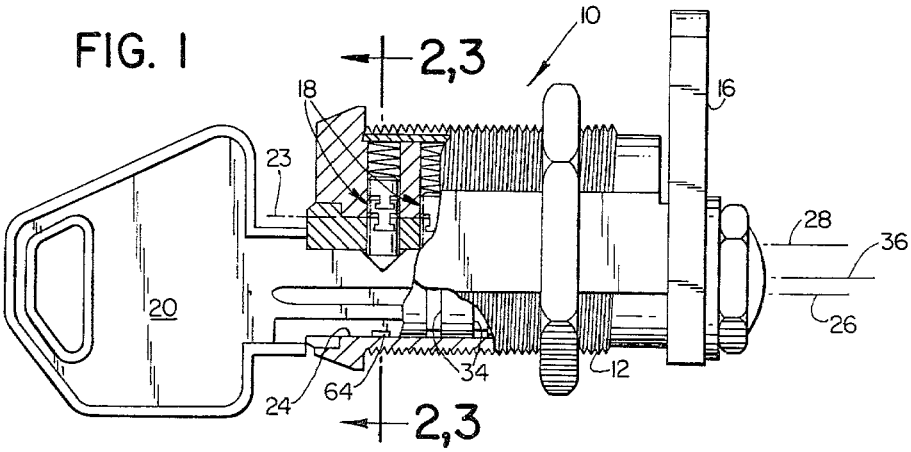
FIG. 1 is a side elevational view of a cam lock embodying the present invention shown with a key therein, a portion of the lock being shown in vertical axial section.
Figure 2:
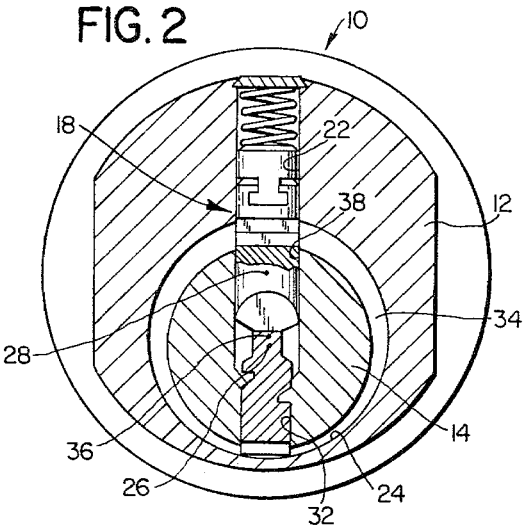
FIG. 2 is a sectional view taken along the line 2—2 of FIG. 1.
Figure 3:
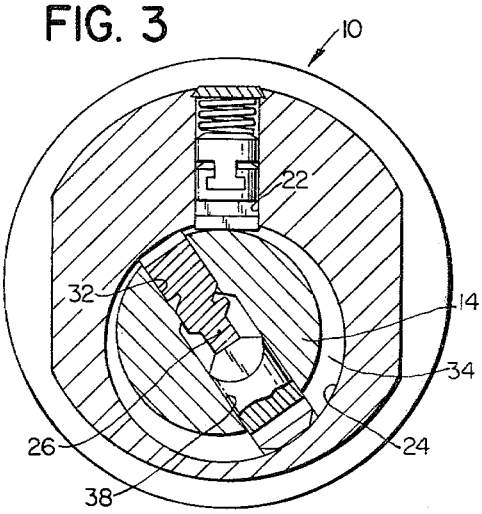
FIG. 3 is similar to FIG. 2 but shows the key plug rotated to an unlocked position.

Turning now to the drawings and considering first particularly FIGS. 1–3, a cam lock embodying the present invention is indicated generally by the reference numeral 10. The illustrated cam lock 10, which is key operated, is particularly adapted for use in a vending machine or the like and has a generally cylindrical shell 12, a key plug 14 supported for rotation within the shell, and a cam 16 mounted on the inner end of the key plug, which projects beyond the inner end of the shell. The cam retains the key plug in assembly with the shell and may be arranged for locking engagement with an associated strike or for operating an associated locking mechanism. A plurality of pin tumbler assemblies 18, 18 spring biased toward locking position normally retain the key plug 14 in locked condition relative to the shell when the key is removed from the lock. A key 20 which operates the lock positions the pin tumbler assemblies to release the key plug for rotation relative to the shell and along a shear line, indicated at 22 in FIG. 1, between locked and unlocked positions, all of which will be hereinafter more fully described.

The shell 12 is generally cylindrical and has an annular mounting flange at its outer end. Preferably, the body portion of the shell has a ¾ inch outside diameter and is threaded to receive a retaining nut such as shown in FIG. 1, which cooperates with the mounting flange to secure the lock to an associated supporting structure, such as a panel of a vending machine (not shown). Both sides of the illustrated shell 12 are slabbed to facilitate non-rotatable mounting within a complementary opening in the panel. A plurality of cylindrical driver holes 22, 22 formed in the upper part of the shell 12 communicate with a bore 24 which extends longitudinally through the lower part of the shell.

The key plug 14 is generally cylindrical and supported within the bore 24 for rotation about an axis 26 which is offset from and parallel to the shell axis indicated at 28 in FIG. 1. Plug 14 is supported for rotation within the bore along the shear line 23, between the plug and the shell. A keyway or key slot 32 formed in the lower part of the plug, as it appears in FIG. 2, extends longitudinally of the plug and opens through its lower peripheral surface. An axially spaced series of annular grooves 34, 34 open radially outwardly through the peripheral surface of the key plug 14. The grooves 34, 34 are coaxially aligned along a groove axis 36 which is offset from and generally parallel to the axis of rotation 26. Cylindrical pin tumbler holes 38, 38, equal in number to the driver holes 22, 22, are formed in the key plug above the keyway communicate with the keyway. Each pin tumbler hole 38 opens through an associated groove 34. However, the width of each groove 34 is substantially less than the diameter of the associated pin tumbler hole 38 which intersects it. When the key plug 14 is in its locked position, as it appears in FIGS. 1 and 2, each pin tumbler hole 38 is coaxially aligned with an associated driver hole 22 and cooperates with the driver hole to define a bore which receives an associated pin tumbler assembly 18. When the key plug is in its locked position, the groove axis 36 is disposed generally between the shell axis 28 and the axis of rotation 26, as shown in FIGS. 1 and 2. It will be further noted that the axes 26, 28 and 38 lie within a common plane when the plug is in its locked position, as best shown in FIG. 2.

Figure 4:
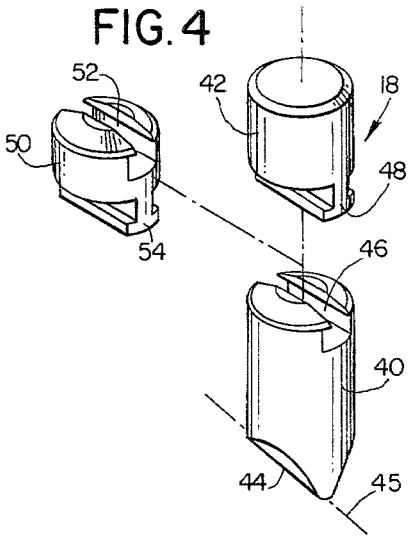
FIG. 4 is an exploded perspective view of a tumbler assembly of the lock of FIG. 1.

The operational principle of the cam lock 10 is similar to the operational principle of the locks illustrated and described in my U.S. Pat. No. 4,103,526, issued Aug. 1, 1978, and assigned to the assignee of the present invention. Each pin tumbler assembly 18 comprises a plurality of tumbler elements which include a pin tumbler 40, carried by the key plug 14, and a driver 42, carried by the shell 12. Each tumbler assembly also has means for coupling the pin tumbler and the driver in end-to-end relation when the plug 14 is in its locked position, as will be hereinafter further discussed. The pin tumbler 40 comprises an axially elongated cylindrical pin which has a key engaging lower end portion shaped to cause axial translation and axial rotation of the tumbler assembly to a predetermined axial and angular release position relative to the key plug and the shell in response to engagement with an associated bit on a properly bitted key, such as the key 20. More specifically, the pin tumbler 40 has a generally V-shaped chisel tip 44 at its lower end defined by planes which intersect at the apex of the chisel tip along a line of intersection 45, as shown in FIG. 4. A slot 46 opens axially outwardly through the upper end of the pin tumbler 40 and extends generally diametrically through the tumbler. Preferably, and as shown, the slot 46 has an inverted generally T-shaped cross-sectional configuration.

The driver 42 comprises a generally cylindrical tumbler element which has a projection 48 at its lower end which extends diametrically thereof. The projection 48 has a generally T-shape cross-sectional configuration which generally complements the configuration of the slot 46. The T-shaped slot 46 and the corresponding T-shaped projection 48 may cooperate to provide means for coupling the driver 42 and pin tumbler 40 in end-to-end relation for axial rotation and axial translation in unison within an associated bore defined by the key plug and the shell. Thus, the driver 42 may be directly coupled to the pin tumbler 40. The illustrated pin tumbler assembly 18 also includes another tumbler element or master pin 50 which has a slot 52 opening axially outwardly through its upper end and extending diametrically through it for receiving and substantially complementing the projection 48 on the driver. The master pin 50 also has a T-shaped projection 54 on its lower end adapted to be received within and to complement the slot 46 in the pin tumbler. When such a master pin is provided as a part of the tumbler assembly 18 it comprises means for coupling the pin tumbler to the driver.

The length of each pin tumbler and the angular arrangement of its slot 46 relative to its chisel tip 44 determines the code of an associated key bit for operating it. In accordance with a presently preferred lock construction, pin tumblers of three general types are employed which provide three basic slot arrangements. One type, shown in FIG. 4 and referred to as a neutral tumbler, has a slot 46 which is aligned with a line of intersection 45 at the apex of its chisel tip formed by the intersection of the planes which define the chisel tip. A pin tumbler may also be provided which has the longitudinal axis of its slot angularly offset 20 degrees in either a clockwise or counterclockwise direction about is axis and relative to the line of intersection 45.

Figure 5:
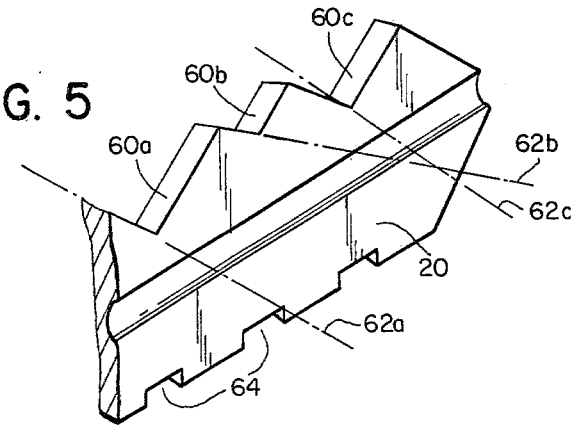
FIG. 5 is a somewhat enlarged fragmentary perspective view of the key of FIG. 1.
Figure 6:
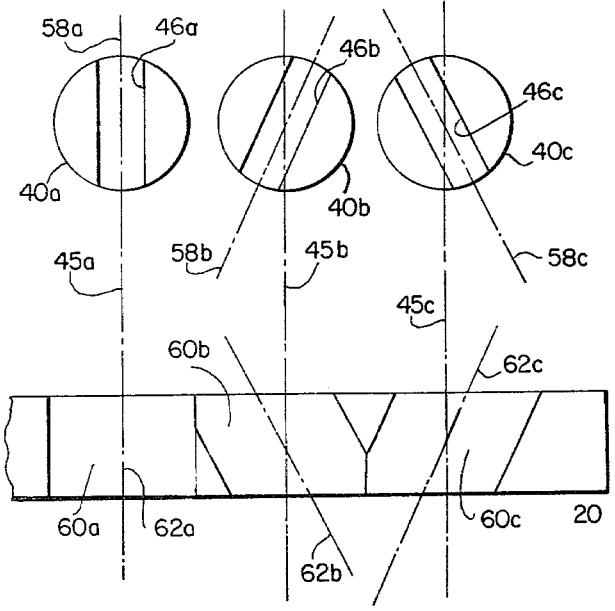
FIG. 6 is a diagramatic plan view of a portion of the key and related pin tumblers of FIG. 1.

Referring now to FIGS. 5 and 6, there is shown a portion of the blade of the key 20. In FIG. 6 the key blade, as viewed from above, is diagramatically illustrated with reference to pin tumblers which it operates, the illustrated tumblers being designated **40*a*–40*c*. The tumbler 40*a* comprises a neutral tumbler, the axis of its slot, indicated at 58*a* being parallel the line of intersection 45*a*, defined the planes of its chisel tip. The corresponding key bit 60*a* which operates the tumbler 40*a* comprises a neutral bit and is cut perpendicular across the longitudinal axis of the key blade. The pin tumbler 40*b* has a 20 degree positive angular offset, that is the slot axis 58*b* is angularly offset 20 degrees in a clockwise direction relative to the line of intersection 45*b*. The key bit 60*b* for positioning the tumbler 40*b* must have a 20 degree negative offset. Thus, for example, the line of intersection 62*b* formed by the intersection of the side walls of the V-shaped bit is angularly off-set 20 degrees in a counterclockwise direction from a neutral axis, that is, an axis normal to the longitudinal axis of the key blade. The remaining pin tumbler 40*c* has a 20 degree negative offset, hence, the corresponding bit 60*c*** which operates this pin tumbler has a 20 degree positive angular offset.

Considering now the operation of the cam lock 10, when the lock is in its locked condition and the key is removed therefrom, the key plug 14 is in its locked position and the tumbler assemblies 18, 18 extend across the shear line 23 between the plug and shell to prevent rotation of the key plug relative to the shell 12. The various tumbler assemblies are or may be disposed in random angular positions within the bores. When the proper key 20 is fully inserted into the key slot the various tumbler assemblies are raised and lowered or axially translated and axially rotated to predetermined release positions wherein a slot 46 or 52 in each pin tumbler assembly 18 is aligned with an associated annular groove 34. When this condition of alignment is attained the longitudinal axis of each slot is aligned with an associated groove 34 and lies generally within the radial plane of the key plug. The key plug may then be rotated in an unlocking direction to separate each pin tumbler from its associated driver. As the key plug 14 is rotated to an unlocked position, such as its position of FIG. 3, each T-shaped coupling projection enters its associated annular groove 34. The side walls of each groove cooperate with the coupling projection therein to prevent the driver associated therewith from rotating about its axis and within its driver hole 22 while the key plug 14 is uncoupled from its associated driver. It will be noted that the key is provided with shallow notches 64, 64 in the lower edge of its blade. Each notch 64 is aligned with an associated groove 34 and provides a continuation of the groove. The notches 64, 64 permit coupling projections, such as the projections 48, 48, to pass therethrough when the key plug is rotated from its 12 o'clock or locked position approximately 180 degrees or more about its axis to an unlocked position.

Rotation of the key 20 and key plug 14 from an unlocked position to locked position (FIG. 2) moves each pin tumbler 40 into coupled relation with its associated driver 42. The key 20 may be withdrawn from the cam lock 10 when the key plug is in its 12 o'clock position. Withdrawal of the key tends to cause random rotation of the various tumbler assemblies which scrambles the tumbler assemblies leaving them in random angular positions relative to the key plug and shell. Reference may be had to my aforesaid patent for a more complete disclosure of a lock embodying the operating principles hereinbefore discussed and said patent is hereby adapted by reference as a part of the present disclosure.

The axially offset or eccentric arrangement of the annular grooves 34, 34 relative to the plug axis 26 facilitates the provision of a high security lock of small size suitable for the various usages hereinbefore described without sacrifice of structural integrity. Specifically, the eccentric arrangement of the grooves 34, 34 permit the notches in the key 20 to be of minimal depth whereby structural integrity of the key blade is maintained.

The lock 10 may be provided with a key plug stop, not shown, for limiting rotation of the plug from its 12 o'clock position in either direction to a 3, 6 or 9 o'clock position, for example.

Figure 9:
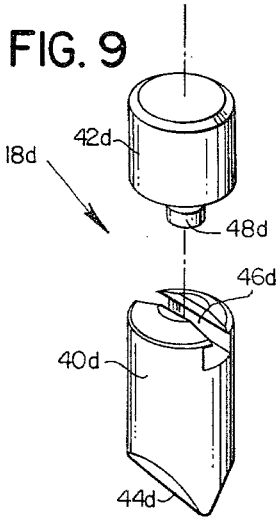
FIG. 9 is an exploded perspective view of a pin tumbler assembly of the cam lock of FIG. 7.
Figure 8:
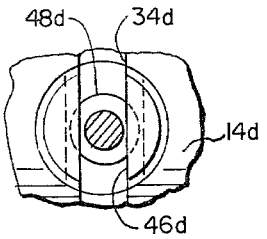
FIG. 8 is a fragmentary sectional view taken along the line 8—8 of FIG. 7.
Figure 7:
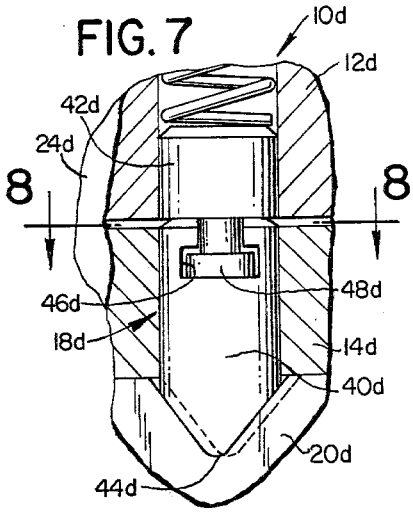
FIG. 7 is a fragmentary vertical axial sectional view through another cam lock embodying the invention.

Referring now to FIGS. 7–9 another lock embodying the present invention is illustrated and indicated generally at **10*d*. The lock 10*d* is similar in most repsects to the lock 10 previously described and parts corresponding to parts hereinbefore described bear the reference numeral 10** and a letter d suffix and will not be hereinafter further described.

The lock **10*d* differs from the previously described one in the construction and arrangement of its pin tumbler assemblies. Specifically, each pin tumbler assembly 18*d* comprises a driver 40*d* and a pin tumbler 42*d*. The driver 40*d* is identical in all respects to the driver 40 and has a chisel tip 44*d* at its lower end and a slot 46*d* formed in its upper end. However, the driver 42*d* differs from the driver 42, previously described, in that it is axially symmetrical. More specifically, the driver 42*d* comprises a generally cylindrical tumbler element which has an axially symmetrical projection 48*d*. The projection is received within the slot 46*d* when the lock 10*a* is in its locked position. Preferably, and as shown, the projection 48*d* has an inverted generally T-shaped cross-sectional configuration as viewed in an axial plane of the driver and the slot 46*a* has a generally T-shaped cross-sectional configuration which generally complements the cross-sectional configuration of the projection 48*a***.

The operation of the lock **10*a* is substantially identical to the operation of the lock 10 previously described. Insertion of a proper key into the keyway serves to align each pin tumbler element 40*d* in a releasing position wherein its slot 46*d* is aligned with an associated groove 34*d* in the key plug 14*d*. Thereafter, rotation of the plug 14*d* relative to the shell 12*d* causes separation of each pin tumbler 40*d* from its associated driver 42*d*. During separation, each pin tumbler 40*d* is entrapped within the plug and restrained against rotation about its axis and relative to the plug by the peripheral surface of the bore 24*d* and an associated bit on the key 20*a*. However, since the projection 48*d* on the driver is axially symmetrical it is not necessary to restrain the driver against rotation while it is separated from the pin tumbler. The projection 48*d* will freely enter the slot 46*d*** in the pin tumbler in any angular position when the plug is rotated to its locked position.

I claim:

1. In a cam lock having a generally cylindrical shell, a plug supported for rotation in said shell about an axis of rotation offset from and parallel to the axis of said shell and along a shear line between locked and unlocked positions, said plug having a keyway therein and an annular groove opening radially outwardly through its peripheral surface, said plug and said shell having holes therein coaxially aligned in locked position and cooperating in locked position to define a bore opening into said groove and communicating with said keyway, an axially elongated cylindrical tumber assembly coaxially supported in said bore and having a plurality of tumbler elements including a pin tumbler carried by said plug and a driver carried by said shell, said pin tumbler having a generally V-shaped chisel tip at one end exposed within said keyway, said pin tumbler assembly having means for coupling said driver to said pin tumbler when said plug is in locked position, said coupling means including a slot opening axially outwardly through an end of one of said tumbler elements and extending generally diametrically through said one element and a projection on an end of another of said tumbler elements received in said slot when said plug is in its locked position, and a key for insertion into said keyway and having means comprising a V-shaped bit engageable with said chisel tip for positioning said pin tumbler assembly within said bore to align said slot with said groove, said groove receiving said projection when said plug is rotated from its locked position relative to said shell, the improvement comprising said annular groove having its axis radially offset from said axis of rotation and parallel thereto.

2. In a cam lock as set forth in claim 1 the further improvement wherein said axis of rotation is disposed between the axis of said shell and the axis of said groove when said plug is in its locked position.

3. In a cam lock as set forth in claim 2 the further improvement wherein said axis of said shell, said axis of said groove and said axis of rotation are disposed in a common plane when said plug is in its locked position.

4. In a cam lock as set forth in any one of claims 1 through 3 the further improvement wherein said one tumbler element comprises said pin tumbler and said other tumbler element comprises said driver.

5. In a cam lock as set forth in claim 4 the further improvement wherein said driver is symmetrical about its axis.

6. In a cam lock as set forth in claim 5 the further improvement wherein said projection has a generally T-shaped cross-sectional configuration as viewed in an axial plane through said one element.

7. In a cam lock as set forth in claim 2 the further improvement wherein the outside diameter of said shell is not greater than 3/5 of one inch.

8. In a cam lock having a generally cylindrical shell, a plug supported for rotation in said shell along a shear line between locked and unlocked positions, said plug having a keyway therein and a groove opening radially outwardly through its peripheral surface, said plug and said shell having holes therein coaxially aligned in locked position and cooperating to define a bore opening into said groove and said keyway, an axially elongated generally cylindrical pin tumbler assembly coaxially supported within said bore and including a pin tumbler carried by said plug and a driver carried by said shell, said pin tumbler having a generally V-shaped chisel tip at one end exposed within said keyway, said pin tumbler having a slot opening through its opposite end and extending transversely through said pin tumbler, said driver having a projection on an end thereof adjacent said opposite end of said pin tumbler and received in said slot when said plug is in said locked position, and a key having means comprising a V-shaped bit engageable with said chisel tip for positioning said pin tumbler within said bore to align said slot with said groove the improvement comprising said projection on said driver is symmetrical about the axis of said driver.

9. In a cam lock as set forth in claim 8 the further improvement wherein said projection cooperates with said slot to couple said pin tumbler and said driver in end-to-end relation against separation in axially opposite directions when said plug is in said locked position.

10. In a cam lock as set forth in claim 9 the further improvement wherein said axially symmetrical projection has a generally T-shaped cross-sectional configuration as viewed in an axial plane of said driver and said slot has a generally T-shaped cross-sectional configuration complementing the cross-sectional configuration of said axially symmetrical projection.

* * * * *